US007445210B2

(12) United States Patent
Emori et al.

(10) Patent No.: US 7,445,210 B2
(45) Date of Patent: Nov. 4, 2008

(54) GAMING MACHINE

(75) Inventors: Kazuki Emori, Tokyo (JP); Shinsuke Yamaguchi, Tokyo (JP)

(73) Assignee: Aruze Corporation, Tokyo (JP)

( * ) Notice: Subject to any disclaimer, the term of this patent is extended or adjusted under 35 U.S.C. 154(b) by 436 days.

(21) Appl. No.: 11/359,782

(22) Filed: Feb. 23, 2006

(65) Prior Publication Data

US 2006/0199640 A1 Sep. 7, 2006

(30) Foreign Application Priority Data

Feb. 23, 2005 (JP) ..... 2005-046484

(51) Int. Cl.
*A63F 7/02* (2006.01)

(52) U.S. Cl. ..... 273/121 B

(58) Field of Classification Search ..... 273/108, 273/118 R, 118 A, 119 R, 119 A, 120 R, 273/120 A, 121 R, 121 A, 121 B; 312/223.1, 312/7.2; 463/20, 46
See application file for complete search history.

(56) References Cited

U.S. PATENT DOCUMENTS

| | | | | |
|---|---|---|---|---|
| 2004/0090151 | A1* | 5/2004 | Nagano | 312/223.1 |
| 2005/0137019 | A1* | 6/2005 | Ikeda | 463/46 |
| 2006/0103502 | A1* | 5/2006 | Kobayashi | 340/5.61 |

FOREIGN PATENT DOCUMENTS

| | | | |
|---|---|---|---|
| JP | 04005984 A | * | 1/1992 |
| JP | 06063234 A | * | 3/1994 |
| JP | 11128483 A | * | 5/1999 |
| JP | 11128484 A | * | 5/1999 |
| JP | 11137814 A | * | 5/1999 |
| JP | 2001232015 A | * | 8/2001 |
| JP | 2002035349 A | * | 2/2002 |
| JP | 2002-085758 | | 3/2002 |
| JP | 2004057457 A | * | 2/2004 |

* cited by examiner

*Primary Examiner*—Raleigh W. Chiu
(74) *Attorney, Agent, or Firm*—Arent Fox LLP

(57) ABSTRACT

To provide a gaming machine wherein a glass plate holding frame is attached so as to be capable of rotating around one side of a frame of a main body of the gaming machine as a rotating axis and the glass plate holding frame holds a glass plate detachably via a holding member disposed at a rear side thereof; and the holding members are provided at the side of the rotating axis, the release side, and the lower part at the rear side of the glass plate holding frame and a glass plate fitting enable part is configured by releasing the upper part; wherein the intervals of the holding members provided at the side of the rotating axis and the release side are configured by securing a moving space for attaching the glass plate fitted from the release side of the glass plate holding frame of the glass plate fitting enable part to a glass plate attached position by moving this glass plate to the side of the rotating axis of the glass plate holding frame.

3 Claims, 14 Drawing Sheets

GAMING MACHINE

CROSS REFERENCE TO RELATED APPLICATION

This application is based upon and claims the benefit of priority from the prior Japanese patent Application No. 2005-046484, filed on Feb. 23, 2005.

BACKGROUND OF THE INVENTION

1. Field of the Invention

The present invention relates to a gaming machine, particularly, the present invention relates to a gaming machine having a glass plate holding frame to which a glass plate is detachably attached via a holding member disposed at its rear side, in which the glass plate holding frame is rotatably provided to a frame of the main body of the gaming machine. Further, the gaming machine according to the present invention applies to both of a pinball machine, so-called pachinko machine, and a recurrent type gaming machine, so-called pachi-slot machine.

2. Description of Related Art

For example, on the pinball gaming machine (so-called pachinko machine), a gaming board configuring a gaming area where a gaming ball is rolling providing various gaming members such as many gaming pins and a gaming ball guiding part (for example, a stage and a sky passage or the like) or the like is attached to the frame of the main body of the gaming machine, and the gaming board is configured so as to be visible via the glass plate of the glass plate holding frame rotatably attached to one side of the frame of the main body of the gaming machine via a hinge or the like.

In such a pinball gaming machine, it is general that the glass plate is detachably attached via the holding member that is disposed to the rear side of the glass plate holding frame.

Conventionally, the pinball gaming machine rotatably provided with the glass plate holding frame in this way is disclosed in Japanese Patent Application Laid-Open No. 2002-85758, and in this Japanese Patent Application Laid-Open No. 2002-85758, the holding member is configured by a holding member at the side of a rotating axis, a holding member at the release side, and a holding member at a lower part communicating over the lower end area of respective holding members. The upper part is a glass plate fitting part that is a released space, and a space of the holding member of the glass plate configured by the holding member at the side of the rotating axis, the holding member at the release side, and holding member at the lower part is made in the size that the glass plate to be fitted can be fit. Then, the glass plate is attached fitting from the above via the glass plate fitting part.

In the meantime, in this kind of pinball gaming machine, for example, above the frame of the main body of the gaming machine, a lamp ornament and a speaker or the like are provided protruding toward the front part, or these lamp ornament and speaker are provided on the glass plate holding frame and these wirings are turned around at the side of the hinge (the side of the rotating axis).

In such a pinball gaming machine, according to the conventional art disclosed in Japanese Patent Application Laid-Open No. 2002-85758, since the holding member is configured in a size that the glass plate is fitted, until the glass plate holding frame is sufficiently released, the working space (the release space) for release of the glass plate holding frame should be sufficiently secured because the above-described respective wirings, lamp ornament, and speaker or the like are interfered upon attachment or detachment of the glass plate.

SUMMARY OF THE INVENTION

An object of the present invention is to provide a gaming machine that can attach and detach a glass plate while preventing interference with a member such as each wiring arranged on a glass plate holding frame and a lamp ornament and a speaker or the like provided on a frame of a main body of the gaming machine as much as possible.

A gaming machine according to the present invention is a gaming machine wherein a glass plate holding frame is attached so as to be capable of rotating around one side of a frame of a main body of the gaming machine as a rotating axis and the glass plate holding frame holds a glass plate detachably via a holding member disposed at a rear side thereof; and the holding members are provided at the side of the rotating axis, the release side, and the lower part at the rear side of the glass plate holding frame and a glass plate fitting enable part is configured by releasing the upper part; wherein the intervals of the holding members provided at the side of the rotating axis and the release side are configured by securing a moving space for attaching the glass plate fitted from the release side of the glass plate holding frame of the glass plate fitting enable part to a glass plate attached position by moving this glass plate to the side of the rotating axis of the glass plate holding frame.

According to the present invention, by employing the above-described structures, it is possible to attach and detach the glass plate from the position separated from the rotating axis of the glass plate holding frame, so that, even in the case that a release angle of the glass plate holding frame is small, it is not so much feared that the glass plate interferes with the wiring arranged at the rear side of the glass plate holding frame and the members such as the lamp ornament and the speaker, the workability of attachment and detachment of the glass plate is improved, and safeness can be also improved without worry about damage of the wiring, respective members, or the glass plate due to interference with the glass plate.

According to the gaming machine of the present invention, a fitting preventing part is provided at the upper end of the holding member that is disposed at the side of the rotating axis of the glass plate holding frame; the glass plate fitting enable part is a space formed between the fitting preventing part and the holding member provided at the release side of the glass plate holding frame; and the lateral width of the glass plate fitting enable part is configured so as to be substantially equal with the width measurement of the glass plate so as to be capable of fitting the glass plate.

According to the present invention, it is possible to prevent the glass plate from being fitted with the glass plate approached the rotating axis by the existence of the fitting preventing part, so that the fitting workability of the glass plate is improved.

The fitting preventing part according to the gaming machine of the present invention is integrally molded with the holding part at the side of the rotating axis of the glass plate holding frame.

According to the present invention, increase of the number of parts can be prevented and it is possible to reduce a manufacturing cost and a part management cost.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

An embodiment of the present invention will be described below. Note that the present embodiment is only an example of the present invention. The present invention is not interpreted in a limited way but the design of the present embodiment can be modified in a scope of the present invention.

According to the present embodiment, as an example of a gaming machine applying the present invention, a pinball gaming machine (also called as a pachinko machine) will be described.

Figure 1:
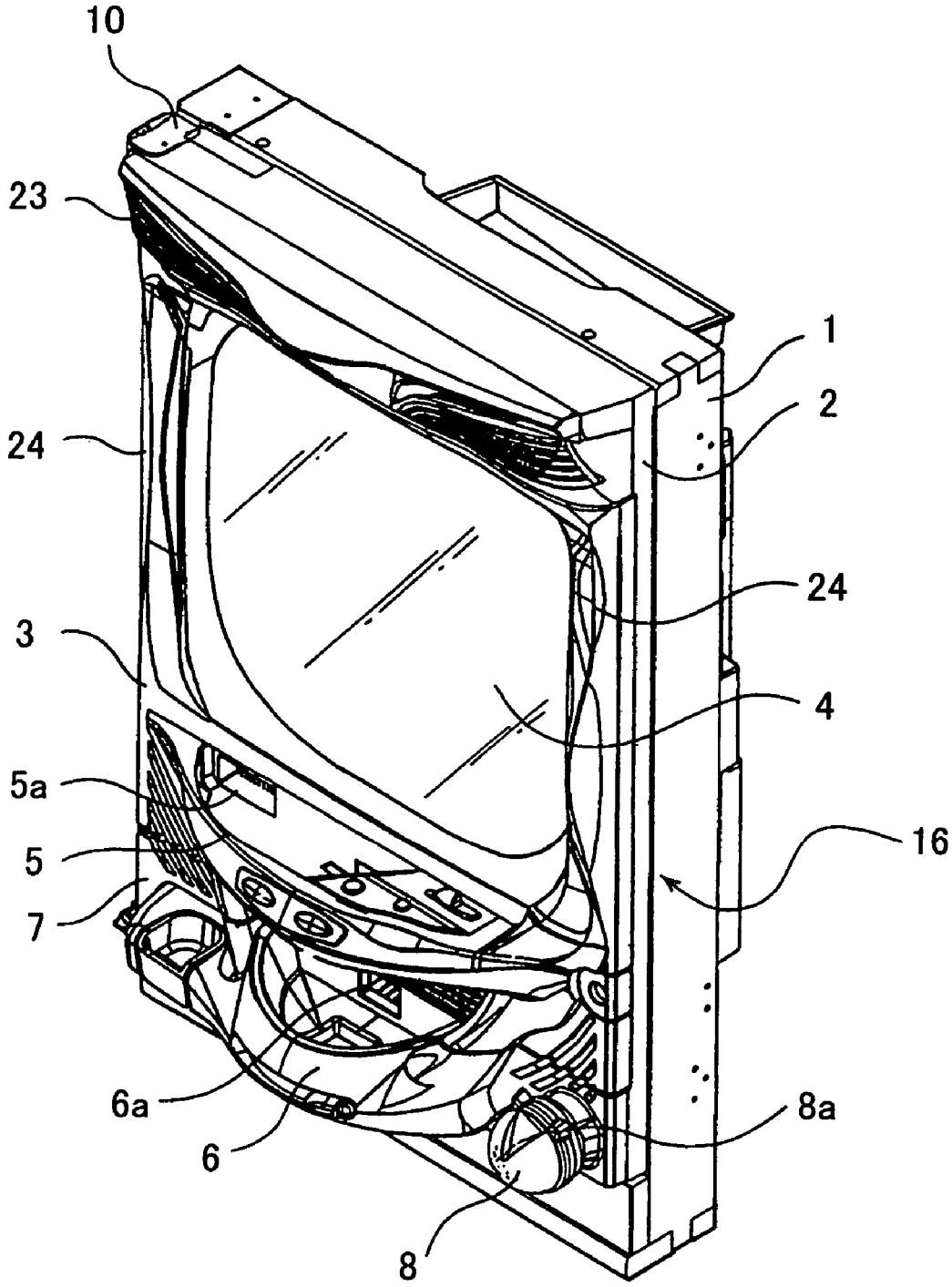
FIG. 1 is an overall perspective view showing the outline of a gaming machine according to the present invention.

FIG. 1 is a schematic perspective view showing an example of a pinball machine applying the present invention, and FIGS. 2 to 5 are schematic view of a glass plate holding frame 3.

The pinball gaming machine is provided with a frame of a main body of a gaming machine that is configured by an outer frame 1 and an inner frame 2. As shown in FIG. 1, the inner frame (base door) 2 is rotatably supported by a shaft on the front face of the outer frame 1, a gaming board (not illustrated) made by providing various gaming members such as starting winning openings and gaming pins on the gaming board base is detachably mounted on the front face of the inner frame 2, and on the back face of the gaming board, a display apparatus (not illustrated) is detachably mounted. In the meantime, the gaming board and the display apparatus are not limited particularly and the designs thereof can be changed in the scope of the present invention.

Then, on the front face of the inner frame 2, as shown in FIG. 1, a glass plate holding frame (a front door) 3 in which a glass plate 4 is fitted is rotatably supported by a shaft at one side of the front face of the inner frame 2 as a rotating axis (a hinge part) 10. When the glass plate holding frame 3 is closed, from the front side of the glass plate holding frame 3, the gaming board is visible via the glass 4.

In addition, according to the present embodiment, as shown in FIG. 1, at the front face of the inner frame 2 above the position where the glass plate holding frame 3 is aligned, a speaker 23 as a staging device by sound is disposed.

Then, at the front face of the glass plate holding frame 3, as shown in FIG. 1, a lamp ornament 24 as the presentation device by light is disposed.

Figure 2:
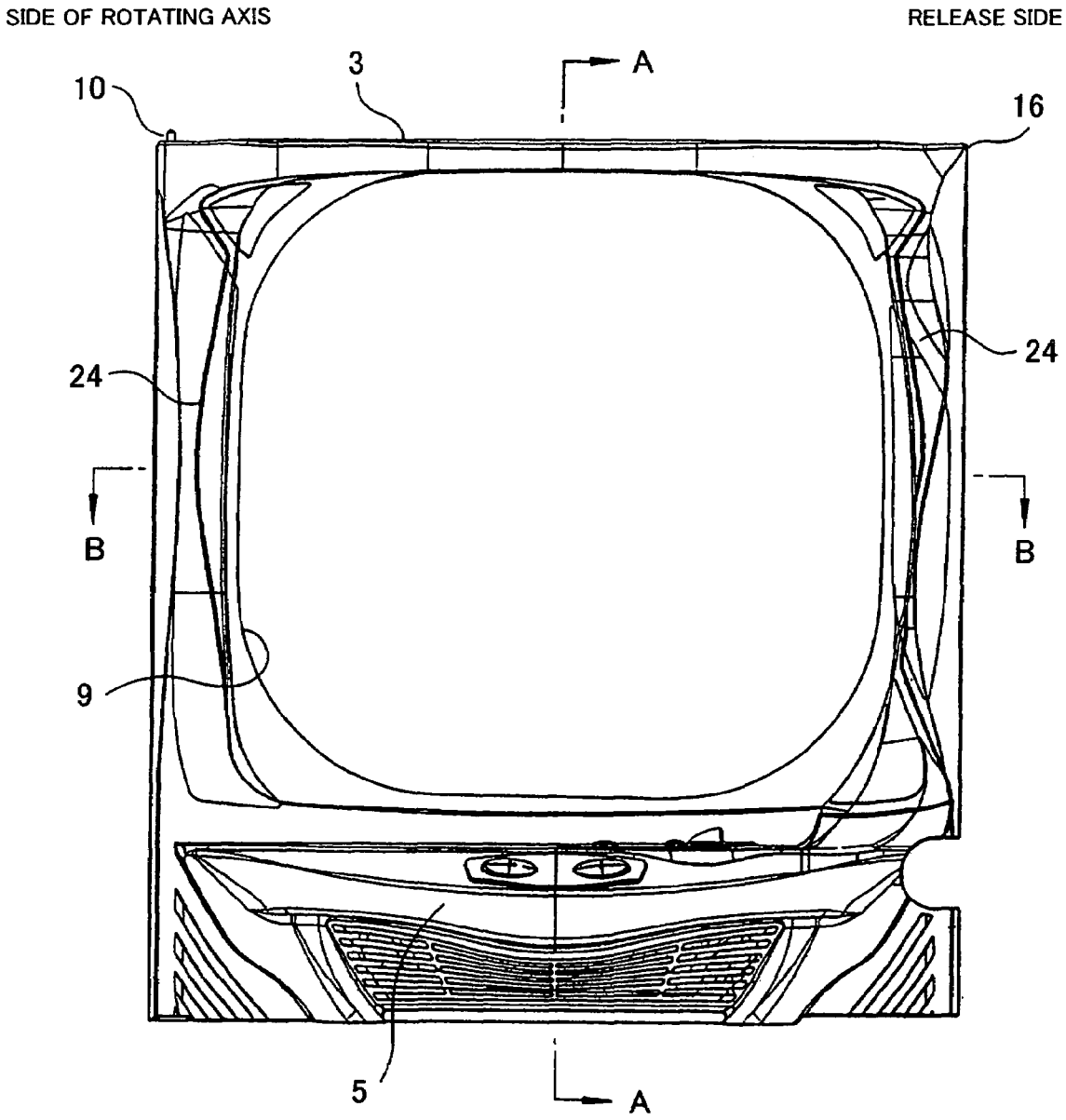
FIG. 2 is a front view of a glass plate holding frame.

At the lower part of the front face of the glass plate holding frame 3, a gaming ball paid out from a payout machine is supplied from a gaming ball accepting entrance 5*a*, and a game ball supply tray (an upper tray) 5 for supplying the gaming ball to an emission device is integrally provided (refer to FIG. 1 and FIG. 2). Then, at the lower part of the front face of the inner frame 2 supporting the glass plate holding frame 3 by a shaft, an attaching base 7 provided with a lower tray 6 having a lower tray discharge port 6*a* for discharging the balls that overflow inside of a gaming ball accepting port 5*a* when the game ball supply tray 5 is full is rotatably supported by a shaft.

In addition, a reference numeral 8 shown in FIG. 1 is a handle of an emission device for emitting the gaming ball toward the gaming area. By rotating a lever 8*a* of this handle 8 in a clockwise direction, an emission stop switch is turned ON, the front of a hammer is operated due to an emission solenoid drive (not illustrated) for driving, and the gaming ball supplied from the game ball supply tray 5 is struck and the gaming ball is punched out to the gaming area that is provided to the gaming board.

At the rear side of the glass plate holding frame 3, a holding member 11 having a glass plate fitting enable part 15 that can fit the glass plate 4 at least on a part thereof is provided around a window part 9 that is disposed on the back and front faces of this glass plate holding frame 3 being opened. The glass plate 4 is detachably held via this holding member 11. In addition, according to the present embodiment, two glass plates 4 are held by the holding member 11 detachably with predetermined intervals back and forth, respectively. Further, the number of the arranged glass plate 4 is not limited to the present embodiment and a single or two and more is possible.

The holding member 11 is formed to be provided with two parallel rail parts 12*a*, 12*a*, 13*a*, 13*a* . . . (slide groove part) are disposed at the inner face. For example, according to the present embodiment, a rotating axis side holding member 12 disposed at the side of a rotating axis 10 of the glass plate holding frame 3, a release side holding member 13 disposed at the release side of the glass plate holding frame 3, and a lower side holding member 14 disposed at the lower side of the glass plate holding frame 3, and the glass plate fitting enable part 15 is formed by releasing the upper part (the upper side at the front seen from the rear side of the glass plate holding frame 3 in FIG. 3 and FIG. 4) of the glass plate holding frame 3.

The rotating axis side holding member 12 is formed by a resin material longer than a longitudinal directional opening width H1 of the window part 9 with two parallel rail parts 12*a*, 12*a* that are released toward the release side 16 of the glass plate holding frame 3 disposed at its inner face side, for example. The upper and lower ends of each rail part 12*a* are released toward the upper and lower direction. In addition, according to the present embodiment, the rotating axis side holding member 12 is configured so as to prevent disengagement of the glass plate 4 in the back and front directions with glass plate disengagement preventing chips 12*b*, 12*b* elongated in a lateral direction on the back and front sides of the upper and lower directions.

Figure 3:
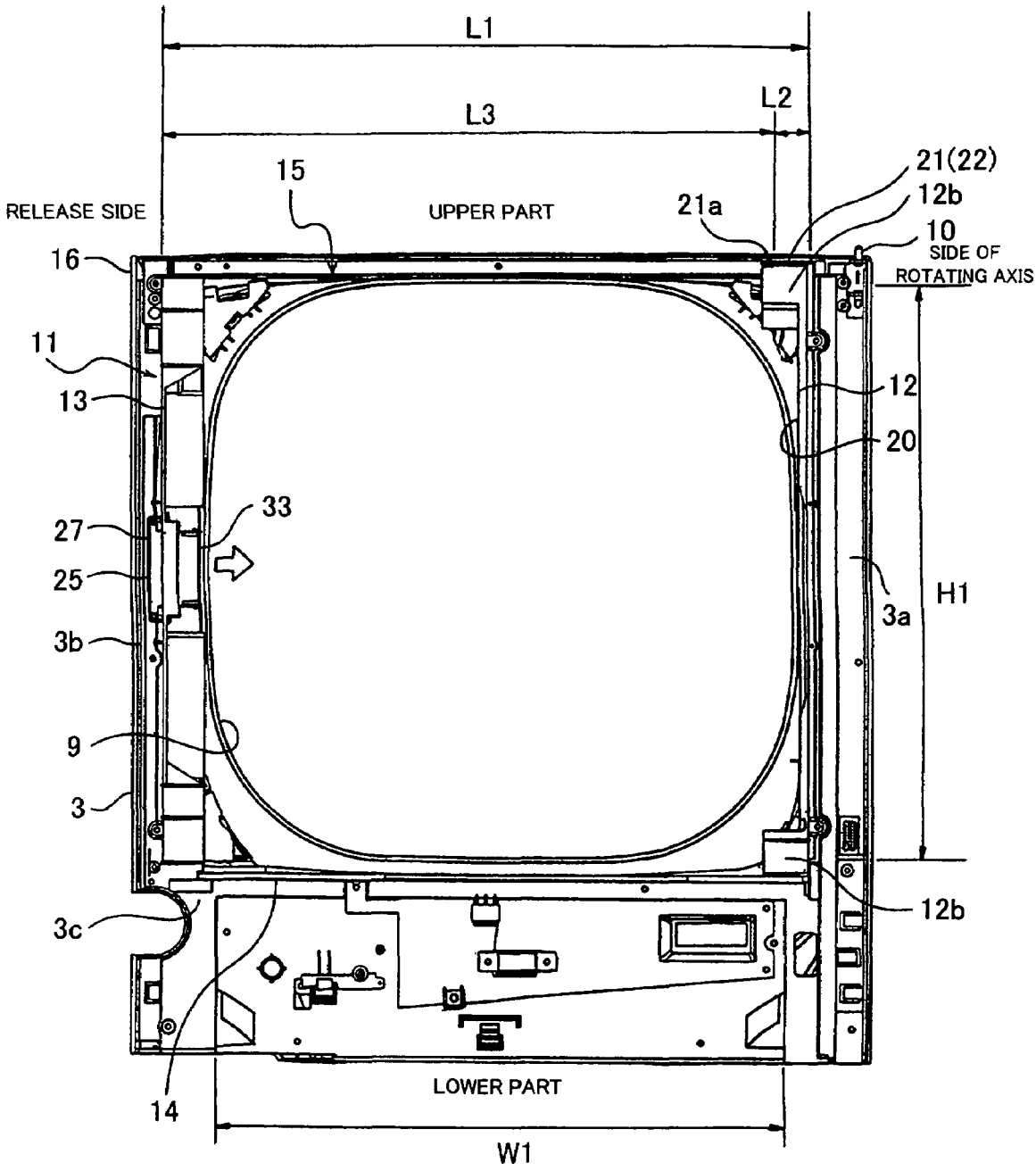
FIG. 3 is a back view of a glass plate holding frame.
Figure 4:
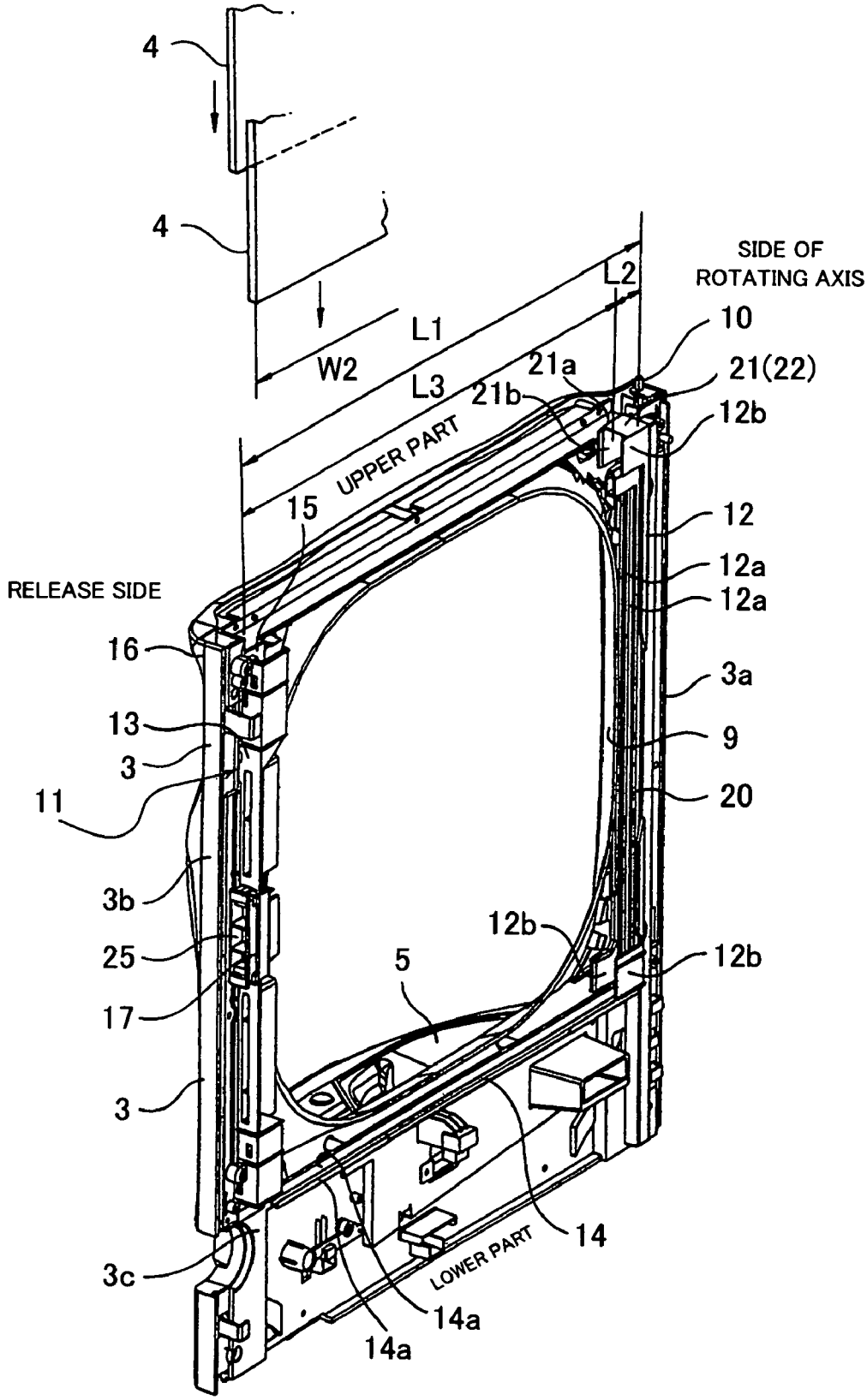
FIG. 4 is a perspective view seeing a glass plate holding frame from the rear side.

Then, the rotating axis side holding member 12 is attached at the side of the rotating axis 10 at the rear side of the glass plate holding frame 3 (the right side at the front seen from the rear side of the glass plate holding frame 3 in FIG. 3 and FIG. 4) in parallel with a rotating axis side longitudinal frame part 3*a* of the glass plate holding frame 3 and near the rotating axis 10 rather than the window part 9.

The release side holding member 13 is formed by a resin material longer than a longitudinal directional opening width H1 of the window part 9 with two parallel rail parts 13*a*, 13*a* that are released toward the rotating axial side 10 of the glass plate holding frame 3 disposed at its inner face side, for example. The upper and lower ends of each rail part 13*a* are released toward the upper and lower direction.

Then, the release side holding member 13 is attached at the release side 16 at the rear side of the glass plate holding frame 3 (the left side at the front seen from the rear side of the glass plate holding frame 3 in FIG. 3 and FIG. 4) in parallel with a longitudinal frame part 3*b* at the release side and near the release side 16 rather than the window part 9. Further, the rail part 13*a* of the release side holding member 13 is located with its opening side mutually opposed to the rail part 12*a* of the rotating axis side holding member 12.

Then, according to the present embodiment, as shown in FIGS. 3 to 5, FIG. 7A and FIG. 7B, a through hole 17 for a moving auxiliary member 25 that inserts and arranges the moving auxiliary member 25 to be described later slidably in a lateral direction is formed at the substantially center position in a length direction passing through from the outer face to the inner face.

Figure 7A:
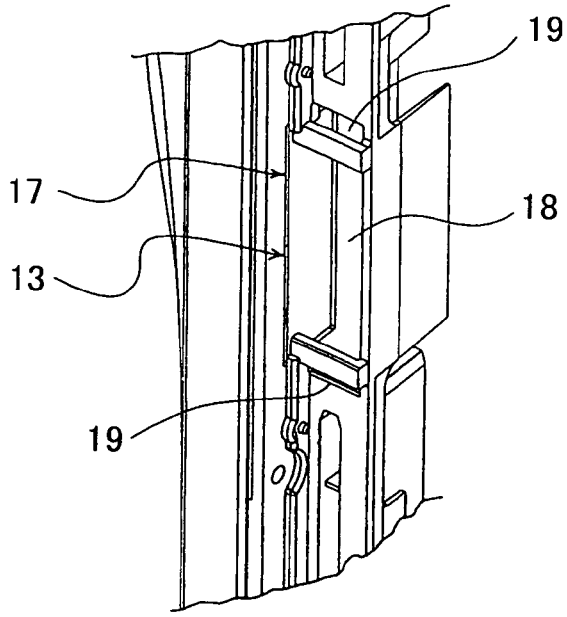
FIG. 7A is a partial perspective view showing the enlarged through hole for a moving auxiliary member, and enlarging the state seen from a direction of inserting the moving auxiliary member.

As shown in FIG. 7A, the through hole 17 for the moving auxiliary member 25 is formed by a first through hole 18 shaped in a long rectangular through which a main body 26 of the moving auxiliary member 25 and a falling preventing part 39 disposed at this main body 26 can be inserted, and a second through hole 19 shaped in a narrow rectangle through which a holding part 45 provided to this moving auxiliary member 25 can be inserted. According to the present embodiment, this second through hole 19 is provided at the opposite sides in the upper and lower directions of the first through hole 18 one by one.

Figure 7B:
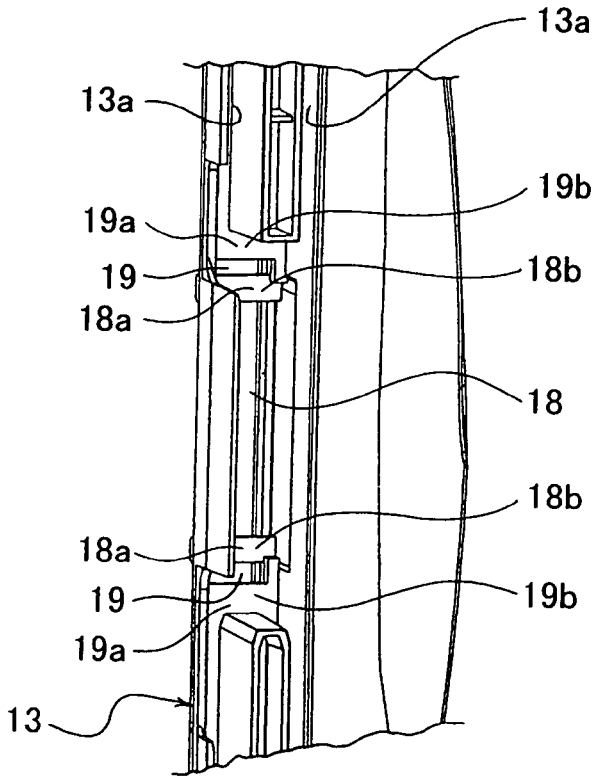
FIG. 7B is a partial perspective view showing the enlarged through hole for a moving auxiliary member, and enlarging the state seen from the rear side.

In addition, as shown in FIG. 7B, this first through hole 18 is provided with a fastening accepting part for preventing falling 18*a* that can be fastened by a fastening chip for preventing falling 42 of the falling preventing part 39 at the inner face of the opposite edges in the upper and lower directions of the first through hole 18. In addition, each second through hole 19 is provided with a fastening accepting part for holding 19*a* that can be fastened by a fastening chip for holding 48 of the holding part 45 at the inner face of the opposite edges in the upper and lower directions of the second through hole 19.

According to the present invention, respective fastened faces 18*b* and 19*b* of the fastening accepting part for preventing falling 18*a* and the fastening accepting part for holding 19*a* are not disposed on the same face, but as shown in FIG. 7B, they are provided in front and behind in the lateral direction. According to the present invention, the fastened face 18*b* of the fastening accepting part for preventing falling 18*a* is provided near the release side 16 rather than the fastened face 19*b* of the fastening accepting part for holding 19*a*. Further, it is also possible to dispose respective fastened faces 18*b* and 19*b* of the fastening accepting part for preventing falling 18*a* and the fastening accepting part for holding 19*a* on the same face by controlling the lengths of the fastening chip for preventing falling 42 and the fastening chip for holding 48.

Figure 5:
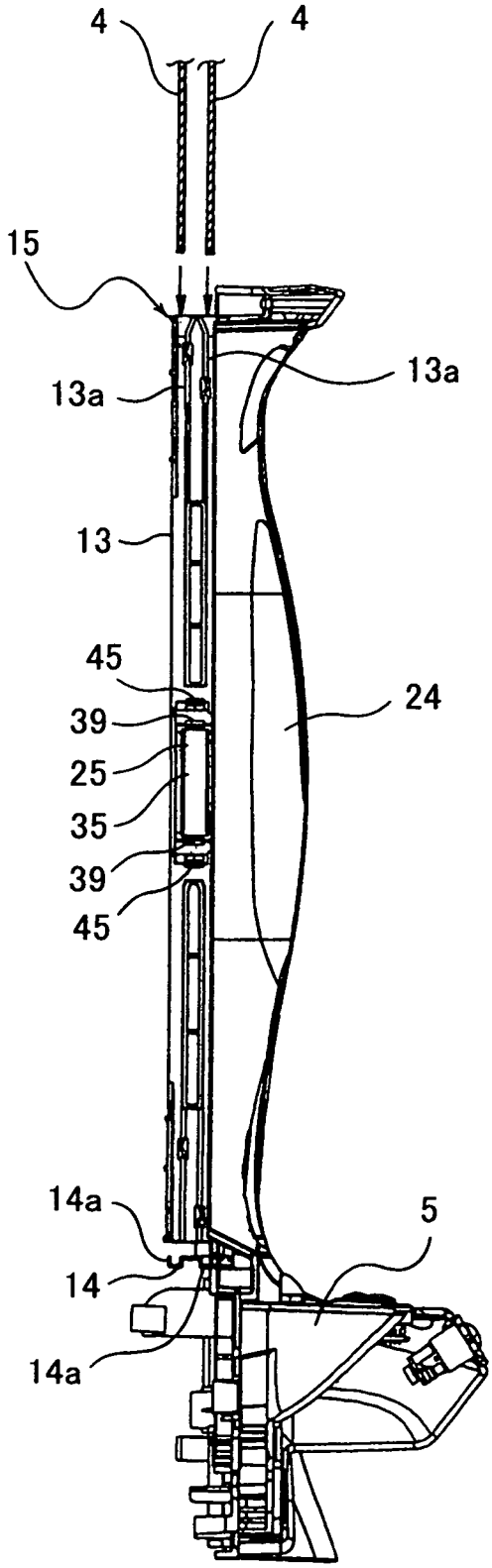
FIG. 5 is a sectional view taken on an A-A line of FIG. 2.
Figure 6:
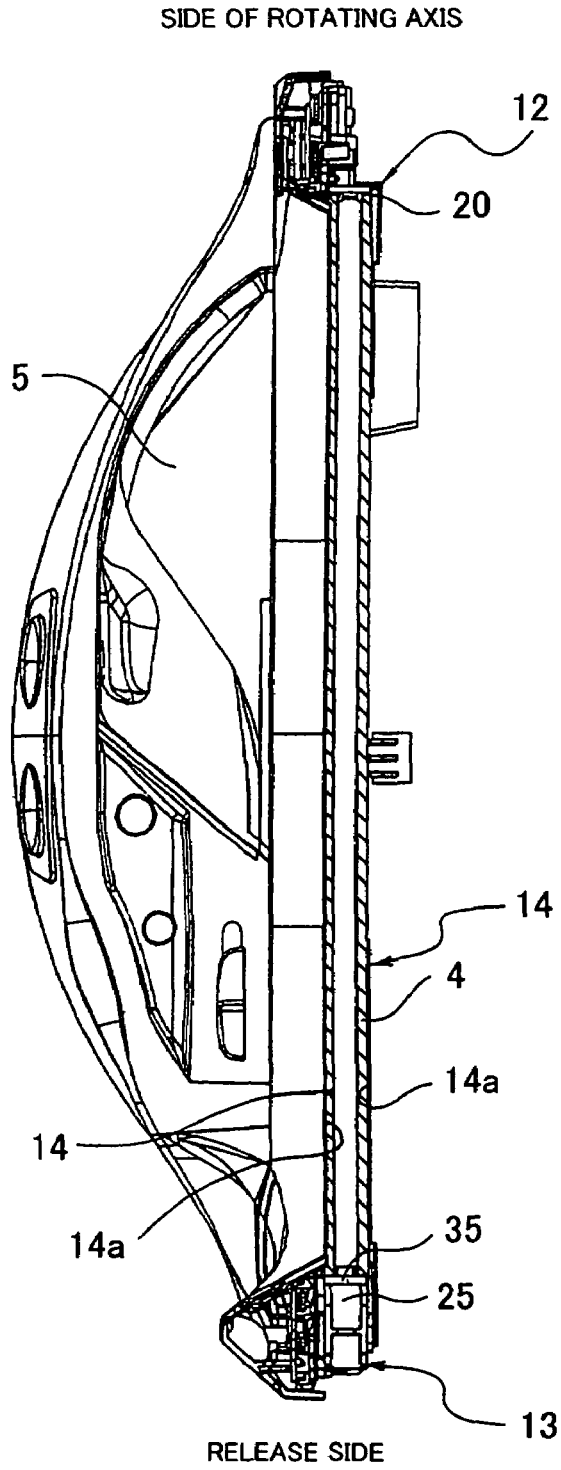
FIG. 6 is a sectional view taken on a B-B line of FIG. 2.

As shown in FIGS. 3 to 5, the lower side holding member 14 is formed by a metal material longer than a lateral directional opening width W1 of the window part 9 with two parallel rail parts 14*a*, 14*a* that are released toward the upper end side of the glass plate holding frame 3 disposed at its inner face side, for example. The right and left ends of each rail part 14*a* are released toward the right and left direction.

Then, the lower side holding member 14 is attached at the lower part of the glass plate holding frame 3 (the lower side at the front seen from the rear side of the glass plate holding frame 3 in FIG. 3 and FIG. 4) in parallel with a lateral frame part 3*c* of the glass plate holding frame 3 lower rather than the window part 9. In this case, the opening of the rail part 14*a* communicates with being perpendicular to the rail part 12*a* of the rotating axis side holding member 12 and the rail part 13*a* of the release side holding member 13.

As shown in FIG. 3, an interval L1 between the inner face side of the rotating axis side holding member 12 and the inner face side of the release side holding member 13 is formed securing a moving space L2 for attaching a glass plate 4 to a glass plate attached position 20 by moving (moving in the observer's right direction in FIG. 3) the glass plate 4 fitted from the above being close to the release side 16 of the glass plate holding frame 3 of the glass plate fitting enable part 15 to the side of the rotating axis 10 of the glass plate holding frame 3. In other words, the interval L1 between the inner face side of the rotating axis side holding member 12 and the inner face side of the release side holding member 13 is larger than a lateral width W2 of the glass plate 4 to be fitted (refer to FIG. 4).

Then, according to the present embodiment, as shown in FIG. 3, FIG. 4, FIG. 12A and FIG. 12B, at the upper end of the inner face side of the rotating axis side holding member 12, a fitting preventing part 21 for preventing fitting within a predetermined rage of the glass plate 4 from the glass plate fitting enable part 15 is provided.

According to the present embodiment, the fitting preventing part 21 is integrally molded at the upper end of the rotating axis side holding member 12 being shaped in a flat late so as to cover the upper end of the rotating axis side holding member 12.

Therefore, according to the present embodiment, a space L3 formed between a loose end side 21*a* of the fitting preventing part 21 and the release side holding member 13 is made into the glass plate fitting enable part 15.

According to the present embodiment, the lateral width of the glass plate fitting enable part 15 (the space L3) is formed to be substantially same as the width measurement (the lateral width W2) of the glass plate 4 so as to enable to fit the glass plate 4.

In addition, above the rotating axis side holding member 12, a disengagement preventing part 22 for preventing the glass 4 from being disengaged to the upper side is provided with the glass plate 4 attached to the glass plate attached position 20.

Further, according to the present embodiment, the disengagement preventing part 22 is also used as the fitting preventing part 21 that is integrally molded with the rotating axis side holding member 12.

In other words, the fitting preventing part 21 can avoid the interference with the lamp ornament 24, the speaker 23, and these wirings or the like as much as possible because the glass plate 4 is fitted from the position near the release side 16 as much as that the fitting preventing part 21 is provided when fitting the glass plate 4 from above of the glass plate fitting enable part 15. In addition, after the fitted glass plate 4 reaches the glass plate attached position 20, the fitting preventing part 21 may act as the disengagement preventing part 22 that prevents movement of the glass 4 upward.

As shown in FIGS. 3 to 6 and FIGS. 8 to 10B, the moving auxiliary member 25 disposed at the glass plate holding frame 3 is provided in the through hole 17 for the moving auxiliary member 25 disposed at the glass plate holding frame 3 so as to be capable of sliding in a lateral direction (capable of sliding from the release side 16 toward the side of the rotating axis 10), and the moving auxiliary member 25 slidably moves the glass plate 4 fitted from the glass plate fitting enable part 15 to the glass plate attached position 20 at the side of the rotating axis 10.

For example, the moving auxiliary member 25 is formed by the main body 26 of the moving auxiliary member 25 formed by a synthetic resin material, a pair of falling preventing parts 39 and a pair of holding parts 45 that are integrally molded by the same material as the main body 26 on the sides of the main body 26 so as to be slidably fitted in the through hole 17 for the moving auxiliary member 25.

Figure 8:
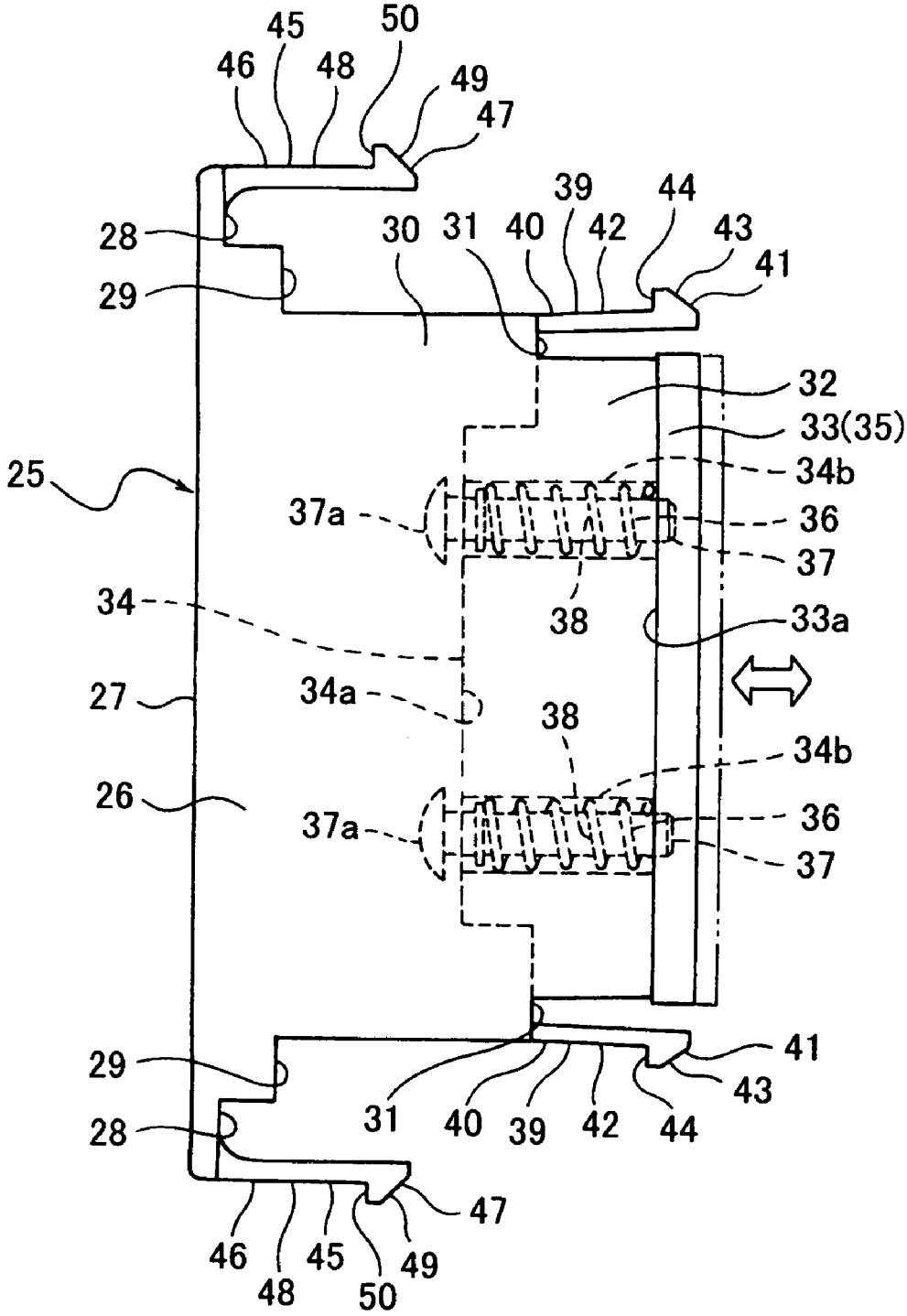
FIG. 8 is a schematic front view of the moving auxiliary member.
Figure 9A:
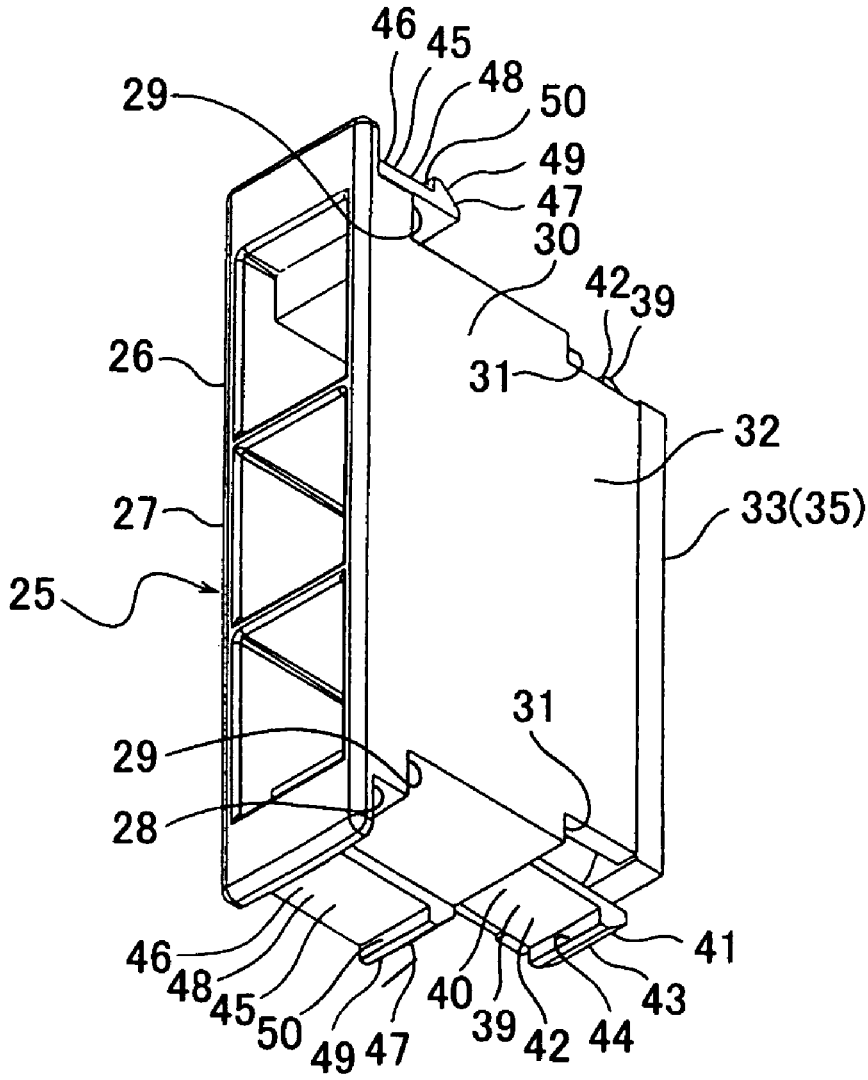
FIG. 9A is a schematic perspective view of the moving auxiliary member and is a perspective view of the state seen from a direction of an operation part.
Figure 9B:
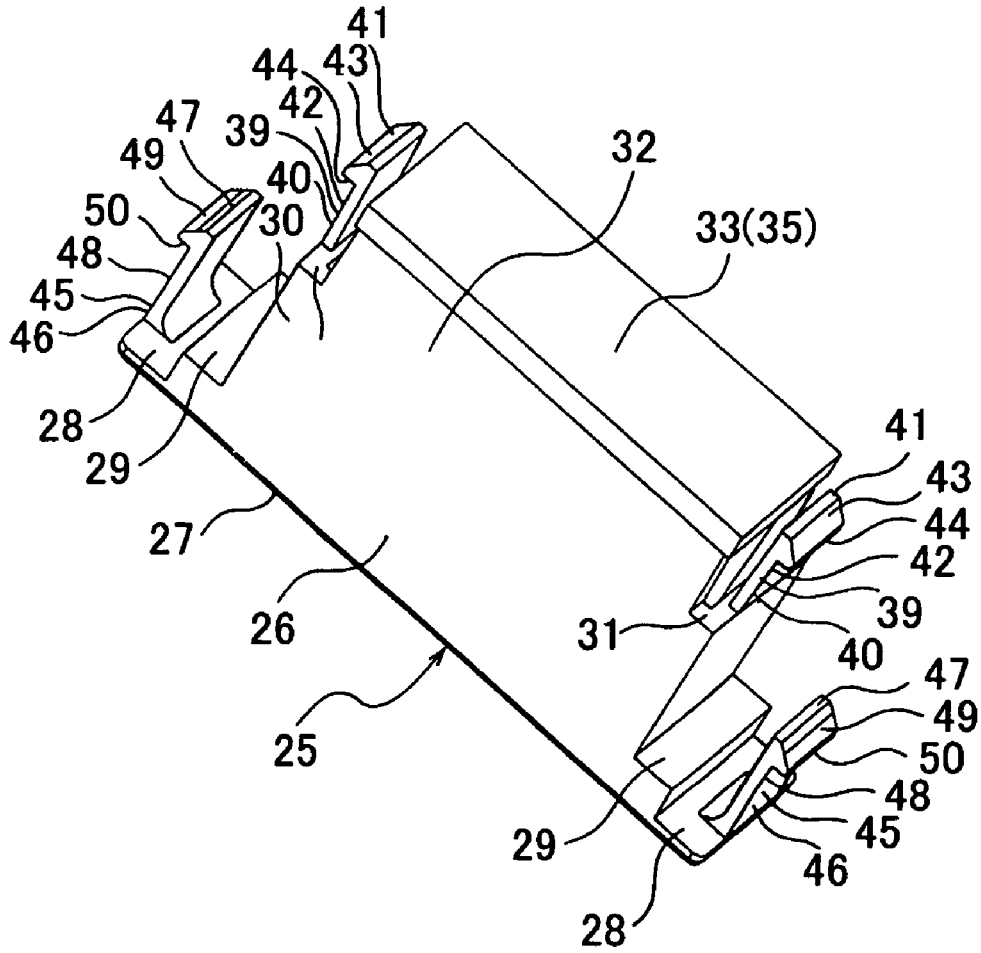
FIG. 9B is a schematic perspective view of the moving auxiliary member and is a perspective view of the state seen from a direction of an abutting part.

For example, according to the present embodiment, as shown in FIG. 8, FIG.9A and FIG. 9B, the main body 26 of the moving auxiliary member 25 is formed by an operation part 27 that is shaped in a long rectangle, a first rising part 29 formed rising at the opposite ends of the front face of the operation part 27 leaving holding part arranging spaces 28, a second rising part 30 formed rising from the front face of the first rising part 29 with a step, and a front end 32 formed rising leaving falling preventing part arranging spaces 31 at the opposite ends of the front face of the second rising part 30. At the front end 32, an abutting part 33 shaped in a long flat form abutting against the glass plate 4 is provided.

In addition, according to the present embodiment, the main body 26 of the moving auxiliary member 25 is formed to be provided with a supporting part 34 inside with a space between the supporting part 34 and the operation part 27 made into a hollow.

According to the present embodiment, the abutting part 33 is formed with a width capable of sliding the two glass plates 4 by pressing them at the same time, and the abutting part 33 is provided with a buffer part 35 to buffer the shock from the glass 4.

The buffer part 35 is formed by a platy member made of, for example, a rubber having a predetermined thickness or a soft synthetic resin material, and provided throughout the front face of the front end 32. Further, the buffer part 35 is not particularly limited if it is made of a material that can absorb the shock from the glass plate 4 and the design thereof can be changed.

According to the present embodiment, the whole of the abutting part 33 is made into the buffering part 35 made of an elastic member. However, the buffer part that is separately formed on a part of the front face of the abutting 33 may be pasted, or the buffer part may be formed by a plurality of intermittent members. If at least the face abutting against the glass plate 4 is made of the elastic member, the design of the buffer part may be changed within a range of the present invention.

In addition, according to the present embodiment, a biasing member 36 is provided, which slides the glass plate 4 by pressing the side face thereof from the position of the glass plate holding frame 3 at the release side 16 and biases the glass plate 4 into the direction of the rotating axis 10 with the glass plate 4 attached at the glass plate attaching position 20.

As shown in FIG. 8, the biasing member 36 is formed by the supporting part 34 provided inside of the main body 26 of the moving auxiliary member 25, a coupling member (a bolt) 37 arranged across the abutting part 33, and an elastic member (a spring) 38 that is wound around the coupling member 37 and intervening across an opposed face 34*a* to the abutting part of the supporting part 34 and an opposed face 33*a* to the supporting part of the abutting part 33. Further, at the rear end of the coupling member 37, a-retaining part (a bolt head) 37*a* that is struck at the outer face of the supporting part 34 is provided.

The coupling member 37 is arranged movably in a direction of the hole within an insertion hole 34*b* of the supporting part 34, and its front end side is fixed to the abutting part 33.

Accordingly, in the abutting part 33, a suppress strength (a shock) is applied at the buffering part 35 at the front end of the abutting part 33 when pressing the glass 4, however, the buffering part 35 is elastically transformed toward the side of the supporting part 34 (the release side 16) by the suppress strength to buffer the shock. Then, when the glass plate 4 reaches the glass plate attached position 20, the elastic member 38 is compressed to tightly press the glass plate 4 on the rail part 12*a* of the rotating axis side holding member 12 by the abutting part 33 via its repulsion (in FIG. 8, a solid line shows the state that the elastic member 38 is compressed and the abutting part 33 moves backward, and a broken line shows the state that the abutting part 33 moves forward without being compressed).

Further, according to the present embodiment, the coupling member 37 and the elastic member 38 to form the biasing member 36 are provided at predetermined intervals in the upper and lower direction for each one set, however, only one set of the coupling member 37 and the elastic member 38, or two and more sets thereof may be possible. The design thereof can be changed within the scope of the present invention.

The falling preventing part 39 prevents the falling of the moving auxiliary member 25 from the glass plate holding frame 3, and in the present embodiment, the following structure is adopted.

According to the present embodiment, for example, as shown in FIG. 8, FIG.9A and FIG. 9B, each of the falling preventing parts 39 is protruded from the upper and lower falling preventing part arranging spaces 31 of the main body 26 of the moving auxiliary member 25 to be perpendicular thereto and the falling preventing part 39 is provided with a tang chip 40 shaped in a platy form that can be elastically transformed, and the fastening chip for preventing falling 42 including a fastening part 41 disposed on the front end outer face of the tang chip 40. The fastening part 41 is formed by a guide face 43 formed from the front end of the tang chip 40 toward outside to be inclined and a fastening face 44 vertically arranged from the guide face 43 toward outside of the tang chip 40.

When the fastening face 44 of the fastening part 41 of the fastening chip for preventing falling 42 is fastened by the fastening accepting part for preventing falling 18*a* disposed at the glass plate holding frame 3, falling of the moving auxiliary member 25 is prevented and by removing the fastened state by elastically transforming the tang chip 40, the moving auxiliary member 25 is disengaged from the fastening accepting part for preventing falling 18*a*, so that the moving auxiliary member 25 can be detached from the glass plate holding frame 3.

According to the present embodiment, for example, as shown in FIG. 8, FIG.9A and FIG. 9B, the holding part 45 serves to hold the glass plate 4 pressed via the moving auxiliary member 25 at the glass plate attached position 20. In the present embodiment, the following structure is adopted as this.

The holding part 45 is configured to protrude perpendicularly from the upper and lower holding part arranging spaces 28 of the main body 26, and to include the tang chip 46 shaped in a platy form that can be elastically transformed and the fastening chip for holding 48 provided with the fastening part 47 disposed on the outer face of the front end of this tang chip 46. This fastening part 47 is configured by a guide face 49 formed from the front end of the tang chip 46 toward the outside to be inclined and a fastening face 50 vertically arranged from the guide face 49 toward the outer face direction of the tang chip 46.

When the fastening face 50 of the fastening part 47 of the fastening chip for holding 48 is fastened by the fastening accepting part for holding 19*a* disposed at the glass plate holding frame 3, the glass plate 4 is held at the predetermined attached position 20 by preventing the moving auxiliary member 25 from moving to the direction of the release side 16. By elastically transforming the tang chip 46, the fastening state is released and this makes it possible to disengage the fastening chip for holding 48 from the fastening accepting part for holding 19*a* and to cancel the holding state of the glass plate 4 at the predetermined attached position 20.

In addition, according to the present embodiment, when the moving auxiliary member 25 holds the glass plate 4 at the glass plate attached position 20 due to the both structures of the falling preventing part 39 and the holding part 45 (the state shown in FIG. 10B), the moving auxiliary member 25 is held without being protruded from the end of the release side 16 at the rear side of the glass plate holding frame 3. When the moving auxiliary member 25 is moved to the release side 16 and the glass plate 4 is kept to be disengaged (FIG. 10A), the gaming machine is configured so that the moving auxiliary member 25 is protruded from the end of the release side 16 of the glass plate holding frame 3. Accordingly, as described above, if the glass plate 4 is held at the glass plate attached position 20, the door of the glass plate holding frame 3 can be closed with respect to the frame of the main body of the gaming machine. However, if the moving auxiliary member 25 is moved to the release side 16 and the glass plate 4 is kept to be disengaged, the door of the glass plate holding frame 3 can not be closed because the moving auxiliary member 25 protruded from the end of the release side 16 gets in the way. With this, it is possible to call forgetting to attach the glass plate 4 and forgetting to set the glass plate 4 at the attached position to a worker's attention.

The entire length of the rotating axis side holding member 12 and the entire length of the release side holding member 13 are not limited to the present embodiment and they can be changed to be longer or shorter. Alternatively, the rotating axis side holding member 12 and the release side holding member 13 may be provided intermittently in a length direction. As a result, according to the present embodiment, the entire length that the length L3 of the glass plate fitting enable part 15 and the length of the moving space L2 that is the space where the glass plate 4 can be pressed and moved is defined as the moving space for the glass plate 4 (the interval L1 between the inner face side of the rotating axis side holding member 12 and the inner face side of the release side holding member 13).

Here, with reference to FIGS. 3 to 6, FIG. 10A, FIG. 10B, FIG. 11A and FIG. 11B, an example of the disengagement operation of the glass plate will be described.

At first, the glass plate holding frame 3 is rotated around the rotation axis as a supporting point to be released.

Then, the glass plate 4 is fitted from above of the holding member 11 at the rear side of the glass plate holding frame 3. In this case, since the fitting preventing part 21 is provided at the upper end of the rotating axis side holding member 12, the glass plate 4 cannot be fit in the holding member 11 unless the fitting preventing part 21 is evaded.

Therefore, in the fitting operation of the glass plate 4, as shown in FIGS. 3 to 5, the fitting preventing part 21 is inevitably evaded and the fitting operation of the glass plate 4 should be carried out from the glass plate fitting enable part 15 that is released at the position separated from the side of the rotating axis 10 for the fitting preventing part 21. With this, there is little risk of interference with the wirings connect to the staging device such as a lamp ornament and a speaker (according to the present embodiment, the speaker 23 disposed above the inner frame 2) and the staging device disposed at the glass plate holding frame 3 (according to the present embodiment, the lamp ornament 24)

Figure 10A:
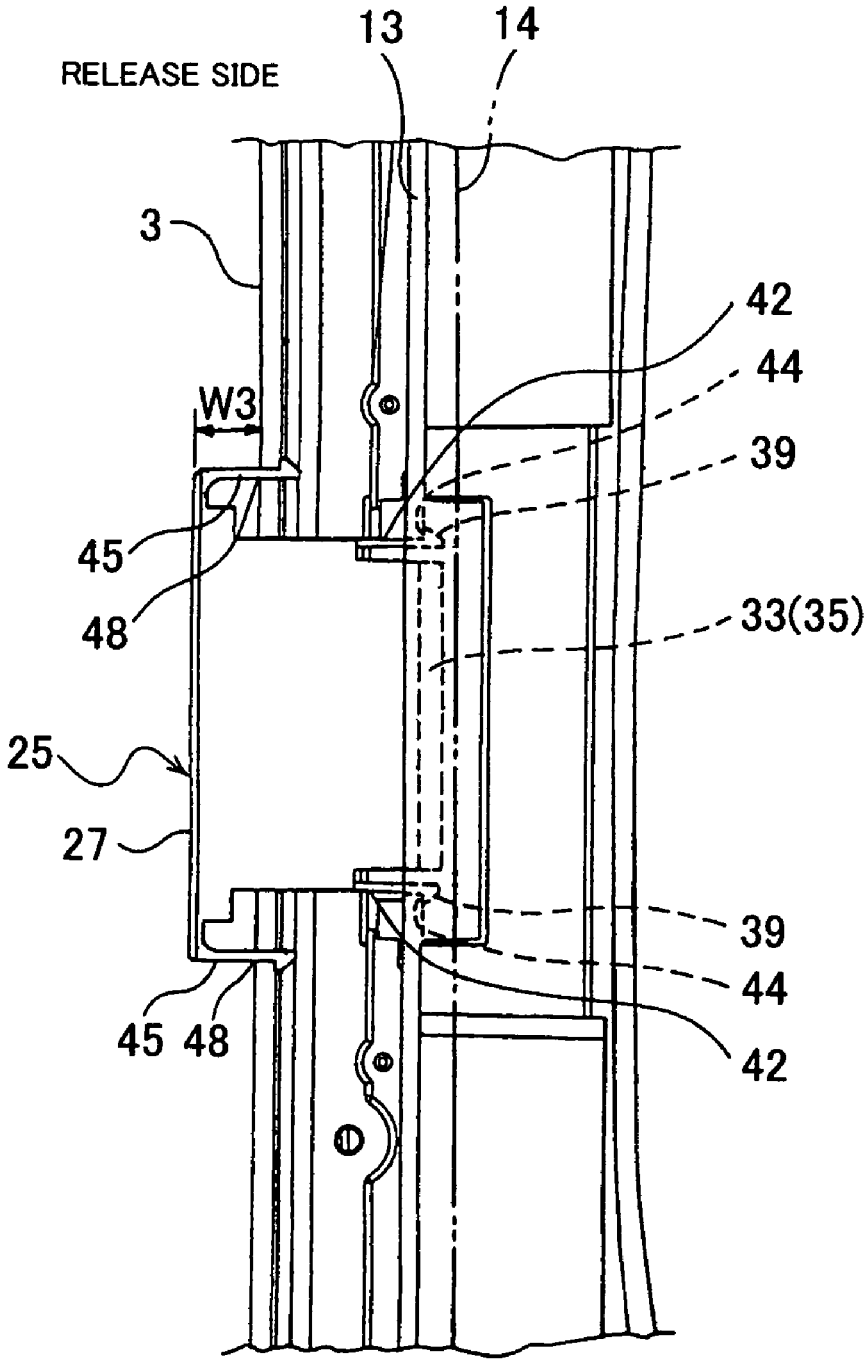
FIG. 10A is a partial enlarged schematic view showing the operation state of the moving auxiliary member and shows the state that the moving auxiliary member is moved to the releasing side and a fastening chip for preventing falling is fastened in a fastening accepting part for preventing falling.
Figure 11A:
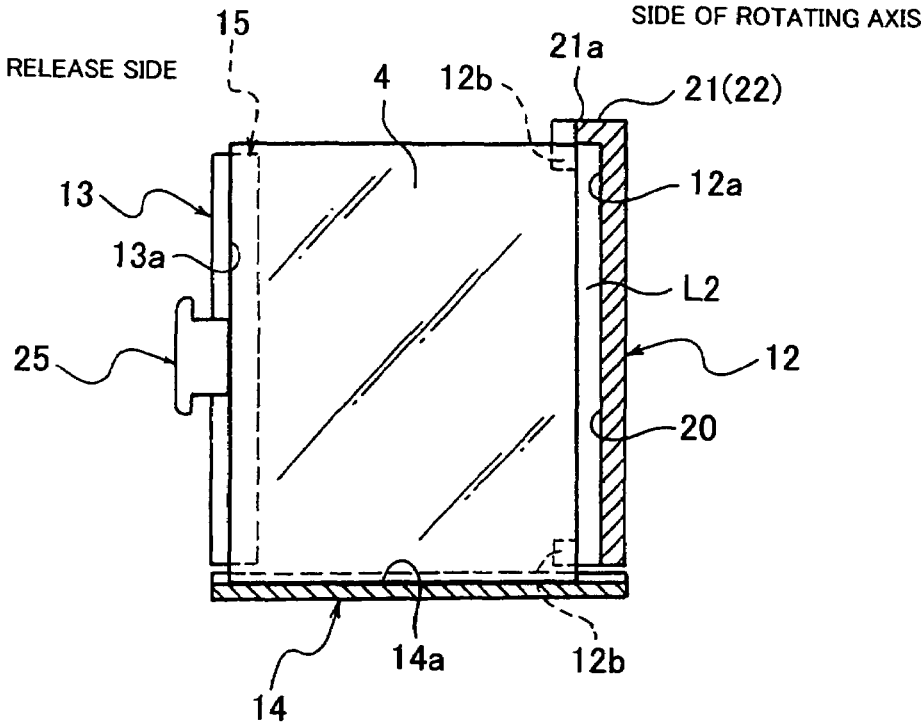
FIG. 11A is a schematic view of the state of the attaching operation of the glass plate, and shows the state just after the glass plate is fitted from a glass plate fitting enable part.

Then, the glass plate 4 fitted in the holding member 11 is pressed to the direction of the glass plate attached position 20 to be slid by the moving auxiliary member 25. In other words, as shown in FIG. 10A and FIG. 11A, the glass plate 4 fitted from the glass plate fitting enable part 15 is located along the inner face side of the release side holding member 13, and the moving auxiliary member 25 moves the glass plate 4 in the first through hole 18 provided at the glass plate holding frame 3 in advance to be protruded to the direction of the release side 16 and this makes the glass plate 4 at the waiting state. The fastening chip for preventing falling 42 of the falling preventing part 39 is fastened at the fastening accepting part for preventing falling 18*a* of the first through hole 18 disposed at the glass plate holding frame 3 to be held without falling.

Figure 10B:
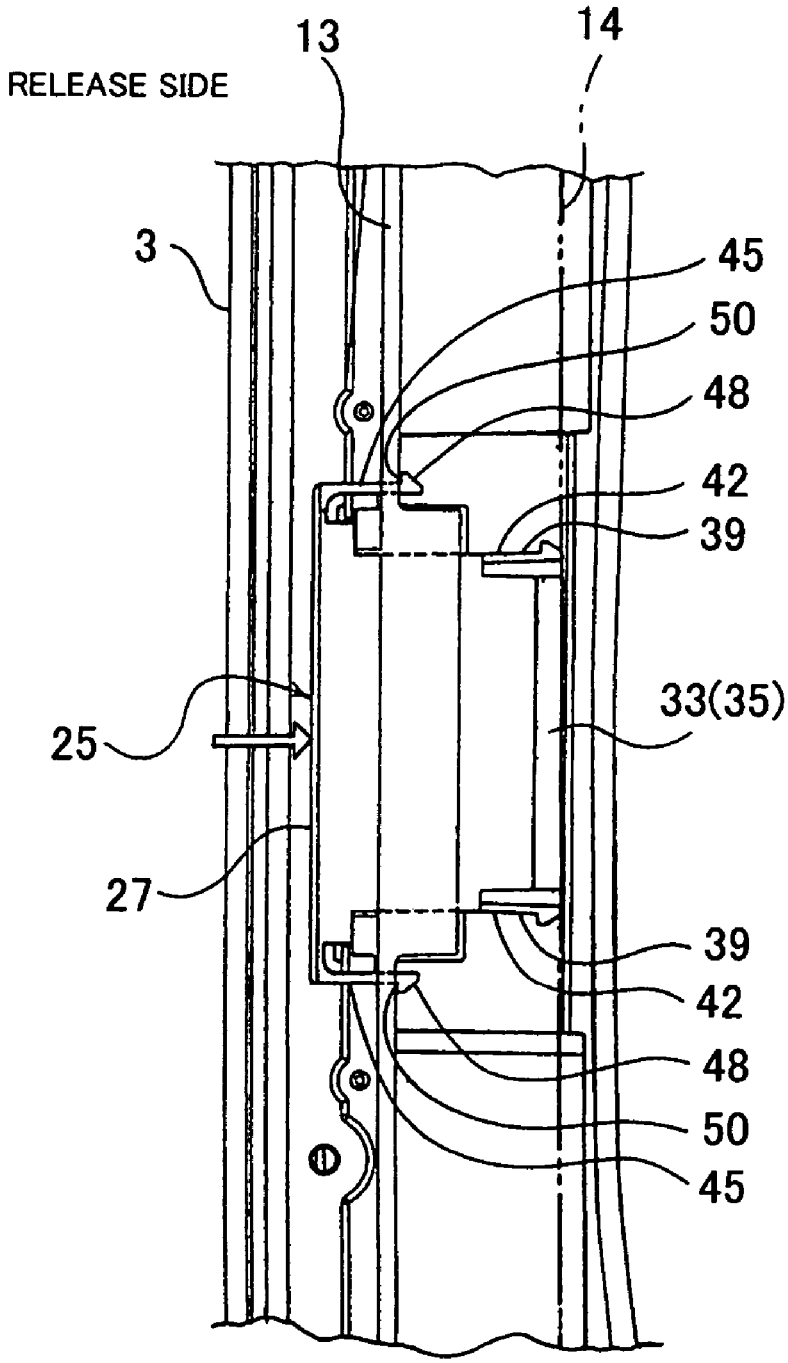
FIG. 10B is a partial enlarged schematic view showing the operation state of the moving auxiliary member and shows the state that the moving auxiliary member is moved to the side of the rotating axis of the moving auxiliary member to press the glass plate on the attaching place and a fastening chip for holding is fastened on a fastening accepting part for holding.
Figure 11B:
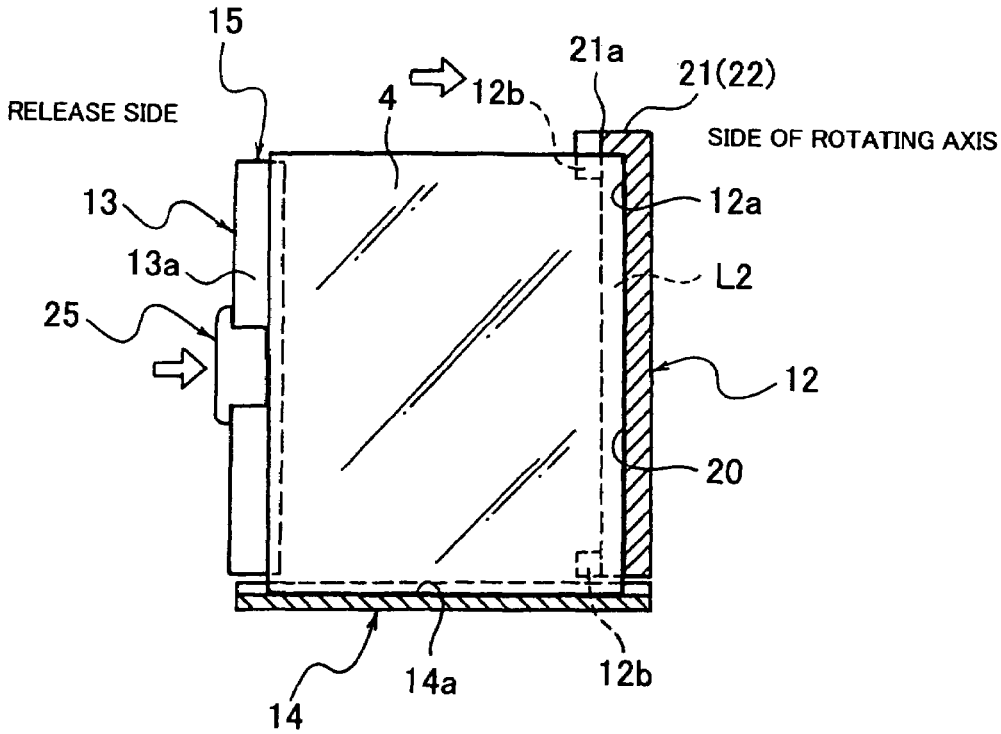
FIG. 11B is a schematic view of the state of the attaching operation of the glass plate, and shows the state that the glass plate is moved to the glass plate attaching position to be pressed and held.
Figure 12A:
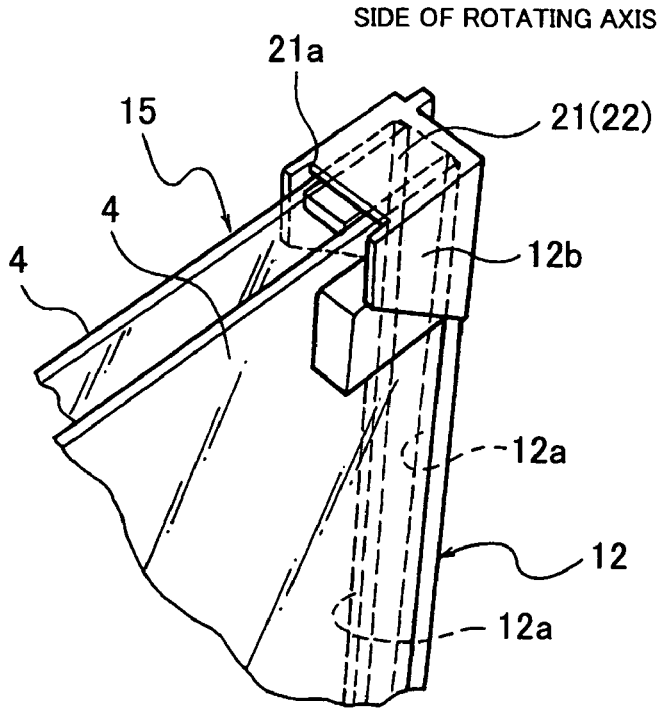
FIG. 12A is a partial omitted perspective view showing the fitting and insertion state of the glass plate, and enlarging near the upper end of the rotating axis side holding member.
Figure 12B:
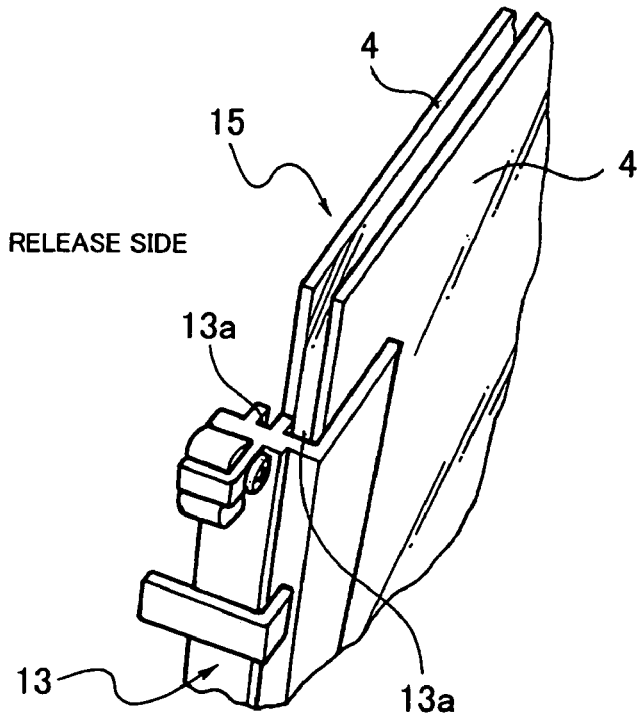
FIG. 12B is a partial omitted perspective view showing the fitting and insertion state of the glass plate, and enlarging near the upper end of the release side holding member.

Then, from the state shown in FIG. 10A and FIG. 11A, the moving auxiliary member 25 is moved into a direction of the side of the rotating axis 10 (a right direction shown by an arrow in the drawing) as shown in FIG. 10B and FIG. 11B, and pressing and moving the glass plate 4 into the direction of the rotating axis side holding member 12 by means of the abutting part 33 of the moving auxiliary member 25, the glass plate 4 is pressed into the direction of the rotating axis side holding member 12 and arranged at the glass plate attached position (the rail part 12*a* of the rotating axis side holding member 12) 20. In this case, the shock with the glass plate 4 applied on the abutting part 33 can be buffered by the elastic transformation of the buffering part 35.

Then, when the glass plate 4 reaches the glass plate attached position 20, the elastic member 38 of the biasing member 36 is compressed to tightly press the glass plate 4 on the rail part 12*a* of the rotating axis side holding member 12 by the abutting part 33 via its repulsion, so that the oscillation of the glass plate 4 is eliminated.

Then, the fastening chip for holding 48 of the holding part 45 is fastened by the fastening accepting part for holding 19*a* at the rear face side of the second through hole 19 disposed at the glass plate holding frame 3.

Thereby, the moving auxiliary member 25 presses and holds the glass plate 4 at the glass plate attached position 20 and the fastening chip for holding 48 is fastened at the fastening accepting part for holding 19*a*, so that movement of the moving auxiliary member 25 and the glass plate 4 toward the release side 16 is prevented.

In addition, in this case, even if the user tries to slide the glass plate 4 upward, the upper end of the glass plate 4 abuts against the disengagement preventing part 22, so that movement of the glass plate 4 upward is prevented and the glass plate 4 cannot be slid. Therefore, irregularity such that the glass plate 4 is slid upward to insert a piano wire or the like can be prevented.

According to the present embodiment, in order to realize such a structure and such an operational effect, in a relation to the conventional art, the following objects can be solved. In other words, when fitting the glass plate from above via the glass plate fitting part, there is a risk to interfere various wirings turned around at the side of the rotating axis, the lamp ornament above the main body of the gaming machine, and the speaker or the like, so that, in order to solve a disadvantage due to the interference, the holding member disposed at the side of the rotating axis is provided at a position sufficiently separated from this side of the rotating axis so as to secure the enough space at the side of the rotating axis at the glass plate holding frame. Under such a condition, since the attached position of the glass plate is limited, the visibility at the inside of the glass plate holding frame at the side of the rotating axis is lowered and it is difficult to improve the ornamental effect on the gaming board.

According to the gaming machine disclosed in the present embodiment, disposing the rotating axis side holding member 12 further near the side of the rotating axis 10 (the hinge side) of the glass plate holding frame 3, the glass plate 4 can be attached further near the side of the rotating axis 10. Accordingly, the visibility of the gaming board at the side of the rotating axis 10 can be improved and this enables to improve the ornament effect of the gaming machine.

(Modification 1)

The above-described first embodiment is merely an example of the present invention, and the following structure can be also adopted.

For example, the materials of the holding member 11 and the moving auxiliary member 25 are not limited to the present embodiment and the designs thereof can be changed within a scope of the present invention.

In the first embodiment, the holding member 11 configures the glass plate fitting enable part 15 releasing the upper part (in FIGS. 3 and 4, the upper side at the front seen from the rear side of the glass plate holding frame 3), however, releasing the part of the release side 16, the glass plate fitting enable part can be configured. In the case of employing this structure, it is provide the holding member at the upper part.

According to the present embodiment, the moving auxiliary member 25 is provided at the substantially center position in the length direction of the glass plate holding frame 3, however, the arrangement position is not particularly limited and it can be selected arbitrarily.

In the present embodiment, the moving auxiliary member 25 is provided at the glass plate holding frame 3 but the attached position is not particularly limited. In addition, the moving auxiliary member 25 may be a separate structure that is used every time the glass plate moving operation is carried out and the design thereof can be changed within a scope of the present invention.

In the present embodiment, the moving auxiliary member 25 is configured to press and move the glass plate 4 to a lateral direction (the direction of the rotating axis). However, this does not limit employment of the other structures. For example, the moving auxiliary member 25 may be also configured in such a manner that, sandwiching the glass plate 4 from above of the glass plate fitting enable part 15, the glass plate 4 may be slidably moved in a lateral direction.

Further, in the present embodiment, an example of the practice of the invention using the moving auxiliary member 25 has been described, however, it is also within a scope of the present invention to employ the structure without using the moving auxiliary member.

It is not necessary that the falling preventing part 39 and the holding part 45 be integrally molded with the moving auxiliary member 25.

Further, in the present embodiment, the structure is employed, in which the falling preventing part 39 is provided with the fastening chip for preventing falling 42 that can be elastically transformed and the glass plate holding frame 3 is provided with the fastening accepting part for preventing falling 18*a* to be fastened by the fastening chip for preventing falling 42. However, the structure is not limited if the fastening chip for preventing falling may be provided on at least any one of the glass plate holding frame 3 and the falling preventing part 39 and the fastening accepting part for preventing falling may be provide on the other thereof. In addition, the structure can be also adopted, in which the fastening chip for preventing falling and the fastening accepting part for preventing falling may be provide at the both of the glass plate holding frame 3 and the falling preventing part 39, respectively.

Further, in the present embodiment, the structure is employed, in which the holding part 45 is provided with the fastening chip for holding 48 that can be elastically transformed and the glass plate holding frame 3 is provided with the fastening accepting part for holding 19*a* to be fastened by the fastening chip for holding 48. However, the structure is not limited if at least one among the glass plate holding frame 3 and the holding part 45 is provided with the fastening chip for holding and other is provided with the fastening accepting part for holding. In addition, the structure that both of the glass plate holding frame 3 and the holding part 45 are provided with the fastening chip for holding and the fastening accepting part for holding may be adopted.

Further, in the present embodiment, an example of practice of the invention provided with the falling preventing part 39 and the holding part 45 has been described. However, to employ the structure that is not provided with the falling preventing part 39 and the holding part 45 is also within a scope of the present invention.

Further, according to the present embodiment, when the fastening chip for preventing falling 42 of the falling preventing part 39 is fastened by the fastening accepting part for preventing falling 18*a* of the release side holding member 13, a part of the moving auxiliary member 25 is protruded from the end of the release side 16 of the glass plate holding frame 3 and the protruded part (in FIG. 10A, the protruded part is shown by the reference mark W3) becomes an obstacle and the door of the glass plate holding frame 3 cannot be closed. With this, it is possible to call forgetting to attach the glass plate 4 and forgetting to set the glass plate 4 at the attached position to the worker's attention. However, it is also within a scope of the present invention that such a structure is not employed. In other words, even when the fastening chip for preventing falling 42 of the falling preventing part 39 is fastened at the fastening accepting part for preventing falling 18*a* of the release side holding member 13, the structure that the moving auxiliary member 25 is not protruded from the end of the release side 16 of the glass plate holding frame 3 is also available.

In the meantime, according to the first embodiment, the structure that the fitting preventing part 21 for preventing fitting and the disengagement preventing part 22 are integrally provided at the upper end of the rotating axis side holding member 12 is employed, however, any one of them may be only provided. Further, the structure that any of them is not provided is also possible in a scope of the present invention. Further, the structure that the fitting preventing part 21 for preventing fitting and the disengagement preventing part 22 may be separately formed from the rotating axis side holding member 12.

In addition, it is also possible in a scope of the present invention to employ the structure that the disengagement preventing part 22 is formed by a different member from that of the rotating axis side holding member 12 and the disengagement preventing part 22 is provided so as to move downward only and to prevent movement upward.

In other words, not particularly illustrated, for example, it is also possible to form disengagement preventing part 22 in a plate with a front and back directional width so as to cover the upper ends of two glass plates at the same time and configure the disengagement preventing part by rotatably supporting the edge of the side of the rotating axis 10 by the axis at the upper end of the rotating axis side holding member 12. Then, the structure is taken as an example, in which this disengagement preventing part biases the part supported by the axis upward by the elastic member, the right and left supporting parts elongated toward the direction of the inner face side of the release side holding member 13 and the back and forth control tang chips opposed to a horizontal direction are protruded at the upper end of the rotating axis side holding member 12 from the supporting part, and at least a part of the upper face of the disengagement preventing part abuts against the back and forth tang chips so as to prevent movement upward.

Further, according to the present embodiment, an example of the practice of the invention provided with the bias member 36 has been described, however, it is also within a scope of the present invention to employ the structure that is not provided with the bias member 36.

The design of the specific structures may be appropriately changed. Further, as the operation and the advantage of the invention described in the embodiment of the invention, only the most preferable operation and advantage caused by the present invention are cited. Therefore, the operation and the advantage of the prevent invention are not limited to those described in the embodiment of the present invention.

While this invention has been described in conjunction with the specific embodiment outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A gaming machine in which a glass plate holding frame is attached so as to be capable of rotating around one side of a frame of a main body of the gaming machine as a rotating axis and the glass plate holding frame holds a glass plate detachably via holding members disposed at a rear side thereof; and the holding members are provided at the side of the rotating axis, the release side, and the lower part at the rear side of the glass plate holding frame and a glass plate fitting enable part is configured by releasing the upper part, wherein the intervals of the holding members provided at the side of the rotating axis and the release side are configured by securing a moving space for attaching the glass plate fitted from the release side of the glass plate holding frame of the glass plate fitting enable part to a glass plate attached position by moving this glass plate to the side of the rotating axis of the glass plate holding frame.

2. The gaming machine according to claim 1, wherein a fitting preventing part is provided at the upper end of the holding member that is disposed at the side of the rotating axis of the glass plate holding frame, the glass plate fitting enable part is a space formed between the fitting preventing part and the holding member provided at the release side of the glass plate holding frame, and the lateral width of the glass plate fitting enable part is configured so as to be substantially equal with the width measurement of the glass plate so as to be capable of fitting the glass plate.

3. The gaming machine according to claim 2, wherein the fitting preventing part is integrally molded with the holding part at the side of the rotating axis of the glass plate holding frame.

* * * * *